United States Patent [19]

Murphy et al.

[11] 4,107,067

[45] Aug. 15, 1978

[54] DETERGENT COMPOSITION

[75] Inventors: Alan Pearce Murphy; John Rene Paris, both of Cincinnati, Ohio

[73] Assignee: The Procter & Gamble Company, Cincinnati, Ohio

[21] Appl. No.: 699,762

[22] Filed: Jun. 25, 1976

[51] Int. Cl.[2] ..... C11D 3/075; C11D 17/00

[52] U.S. Cl. ..... 252/135; 252/89 R; 252/316; 252/DIG. 1; 252/11; 252/14

[58] Field of Search ..... 252/89, 135, 316, 317, 252/DIG. 1, 11, 14

[56] References Cited

U.S. PATENT DOCUMENTS 3,849,347 11/1974 Tokiwa et al. ..... 252/545

*Primary Examiner*—P.E. Willis, Jr.

*Attorney, Agent, or Firm*—Jerry J. Yetter; Julius P. Filcik; Richard C. Witte

[57] ABSTRACT

Detergent compositions are provided in the form of inversed emulsions, wherein the continuous phase comprises a highly concentrated detersive surfactant and wherein the disperse phase comprises a highly concentrated electrolyte, preferably a detergency builder.

12 Claims, No Drawings

DETERGENT COMPOSITION

BACKGROUND OF THE INVENTION

The present invention relates to detergent compositions particularly adapted for direct application to fabrics as spot and grease removers, as well as for being used in the manner of commercial detergents in the main wash. More particularly, the detergent compositions herein comprise inversed emulsions which are in the form of gelatinous liquids or somewhat thicker, yet flowable, gels, and are especially useful for removing both greasy stains and particulate soils from fabrics.

Heavy-duty liquid detergent compositions are well known in the art. Usually, such compositions contain a synthetic organic detergent component which is generally anionic, nonionic or mixed anionic-nonionic in nature, an inorganic builder salt, and a solvent, which usually comprises water and/or alcohol. Such compositions frequently contain a hydrotrope or solubilizing agent to permit the addition of sufficient quantities of detergent and builder salt to provide a reasonable volume/usage performance ratio. While such liquid detergent compositions are effective for some types of home laundering, they are not optimally useful both as pre-treatment and through-the-wash fabric cleaning compositions.

Typical examples of concentrated liquid detergents are disclosed in U.S. Pat. Nos. 2,086,867, Hall 7/1937; U.S. Pat. No. 2,551,634, Price 5/1951; U.S. Pat. No. 2,770,599, Henkin 11/1956; U.S. Pat. No. 2,947,702, Coskie 8/1960; U.S. Pat. No. 3,239,468, Herrick 3/1966; U.S. Pat. No. 3,554,916, Kerfoot 1/1971; U.S. Pat. No. 3,594,323, Taylor 7/1971; U.S. Pat. No. 3,663,445, Augustin 5/1972; U.S. Pat. No. 3,697,451, Mausner, et al. 10/1972; and U.S. Pat. No. 3,709,838, Mausner, et al. 1/1972.

Relevant foreign patents include: Canadian Pat. No. 615,853, 2/1961; and British Pat. No. 900,000, 6/1962; British Pat. No. 842,813, 7/1960; and British Pat. No. 759,877, 10/1956.

Other relevant references include Kastra, Defensive Publication of Ser. No. 182,863, filed 9/22/71 No. T903,009; Kastra, Defensive Publication of Ser. No. 182,883, filed 9/22/71 No. T903,010, and "Emulsions and Detergents", a booklet published by Union Carbide, 1961, especially pp. 7–9.

Some highly preferred, heavy-duty liquid detergent compositions are disclosed by Collins in U.S. Pat. No. 3,869,399, issued Mar. 4, 1975, and in U.S. Pat. No. 3,876,563, issued Apr. 8, 1975. The compositions disclosed in these patents are taught to be in gel form, provided no alcohol or electrolyte is present therein. The reference cited at column 1 of each of these latter patents also disclose a variety of heavy-duty (not necessarily liquid) detergent compositions.

Compositions comprising electrolyte, water, and surfactant which seems to have been "salted-out" of solution by means of the electrolyte are disclosed in U.S. Pat. No. 3,235,505, Tuvell, issued Feb. 15, 1966. The disclosed compositions appear to comprise a continuous aqueous phase and a disperse surfactant phase, i.e., the converse of the compositions disclosed herein, and apparently contain substantially less nonionic surfactant than do the cmpositions herein. See also U.S. Pat. No. 3,591,508, Huggins, et al., issued July 6, 1971; and U.S. Pat. No. 3,060,124, Ginn, issued Oct. 23, 1962.

Pumpable liquid compositions consisting of concentrated ethoxylated nonionic surfactants and water are disclosed in U.S. Pat. No. 3,419,500, Rytter, et al., issued Dec. 31, 1968.

Non-gelling, concentrated liquid detergents are disclosed in U.S. Pat. No. 3,812,041, Inamorato, issued May 21, 1974.

Pasty spot-treating detergent concentrates are disclosed in U.S. Pat. No. 3,619,119, Felletschin, et al., issued Nov. 9, 1971.

Ethoxylated detergent compositions thickened with a polyvinyl acetate maleate thickener are disclosed in U.S. Pat. No. 2,645,415, Pollok, issued July 14, 1963.

Liquid detergent concentrates are disclosed in U.S. Pat. No. 3,776,581, Cheng, issued Dec. 4, 1973.

Detergents comprising anionic and nonionic surfactants are disclosed in U.S. Pat. No. 3,140,261, Noad, issued July 7, 1964.

German Offen. No. 2,403,229, Anmeldetag, Jan. 14, 1974, Smithies, discloses detergent concentrates with indicator systems.

In spite of the substantial body of work in the area of heavy-duty liquid detergents, the particular advantages and superior performance of compositions of the type disclosed herein do not appear to have been appreciated heretofore.

SUMMARY OF THE INVENTION

The detergent compositions of the present invention are in the form of pourable or flowable gels. As such, the compositions herein are especially adapted for direct application to stains and soils on fabrics as a pretreatment prior to aqueous laundering, as well as for direct addition to an aqueous laundering liquor. In their flowable gel form, the compositions herein are especially advantageous as a laundry pretreatment, inasmuch as they do not substantially "wick" into and through fabrics, and thus remain in highly concentrated and active form on the solid site to which they are applied.

The compositions herein provide excellent removal of both greasy and particulate soils when used to pretreat and launder fabrics. These desirable benefits are secured without recourse to flammable organic solvents such as various alcohols and hydrocarbons used in some art-recognized heavy-duty liquid detergents.

The desirable thickness aspects of the compositions herein which contributes to their ease-of-use and effectiveness is achieved by providing the compositions in the form of inversed emulsions. Accordingly, the use of extraneous thickening adjuvants is not necessary or desirable when preparing the present compositions.

Succinctly stated, the present invention encompasses concentrated, heavy-duty detergent compositions which are gelatinous liquids or flowable gels. For reasons disclosed more fully hereinafter, it is critical that the present compositions comprise greater than about 40% by weight of detersive surfactant, from about 2% to about 10% by weight of electrolyte, the balance comprising water.

The compositions herein are homogeneous, inversed emulsions, said inversed emulsions constituting two phases. The first phase is a continuous phase which contains substantially all of the detersive surfactant present in the compositions in the form of hydrated neat liquid crystals.

The second phase of the compositions herein is the disperse phase, which is an aqueous solution containing substantially all of the electrolyte. The disperse phase is substantially homogeneously distributed throughout the continuous phase and remains distributed therethrough by virtue of the "matrix" provided by the hydrated neat liquid crystals which constitute the continuous phase.

The invention herein also encompasses a means for preparing detergent compositions in the form of gelatinous liquids or flowable gels without the use of extraneous thickening adjuvants. Briefly, the process herein comprises admixing a nonionic alkylene oxide detersive surfactant, water and electrolyte. These ingredients are mixed in critical proportions, whereby a continuous phase comprising hydrated, nonionic alkylene oxide detersive surfactant is "salted-out" in the form of hydrated neat liquid crystals of the type disclosed hereinabove. The continuous, liquid crystalline phase has substantially homogeneously distributed therethrough a disperse phase comprising an aqueous solution containing the electrolyte.

A method for cleansing fabrics using the aforesaid compositions is also provided.

DETAILED DESCRIPTION OF THE INVENTION

The detergent compositions of the present invention comprise a continuous phase made up of hydrated detersive surfactant in the form of neat liquid crystals, and a water/electrolyte disperse phase. The neat liquid crystalline continuous phase constitutes a flowable matrix and has the aqueous electrolyte solution substantially homogeneously distributed therethrough. The flowable matrix nature of the continuous liquid crystalline surfactant phase suspends the disperse phase and thus imparts both stability and homogeneity to the gelatinous liquid or flowable gel forms of the compositions herein without resort to extraneous thickeners.

By having the detersive surfactant in the highly concentrated hydrated neat liquid crystal form, and by choosing as the electrolyte a detergency builder material which is present in highly concentrated form in the aqueous medium (droplets) which constitute the disperse phase, compositions which deliver an extremely concentrated and effective combination of detersive ingredients to remove soils from fabrics are provided.

By the term "detersive surfactant" herein is meant a surface-active agent which is capable of lowering the surface tension at the air/water interface and which is capable of removing soil from solid surfaces, especially fabrics. The nonionic detersive surfactants used herein are described in great detail, hereinafter.

By the term "neat liquid crystals" herein is meant the art-recognized two-dimensional stable molecular aggregates, of so-called "2-dimensional crystalline structure", which are formed on addition of water to certain surfactants. Using standard techniques, the "neat" phase of the liquid crystalline surfactant structure herein can be noted microscopically as light, birefringent streaks on a black background when the surfactant material in the neat phase is placed between cover slips and viewed under crossed Nicol prisms. Macroscopically, surfactants in the neat phase are substantially thicker than when formulated as simple solutions.

By the term "gelatinous liquid" herein is meant a somewhat thickened, freely flowing material having a viscosity in the range of ca. 500 cps to 10,000 cps (Brookfield; 72° F; spindle #3).

By the term "flowable gel" herein is meant a substantially thickened material having a viscosity in the range of ca. 10,000 cps to 50,000 cps (Brookfield; 72° F; spindle #6). The flowable gels herein move freely from flexible containers on application of slight hand pressure.

By the term "compatible" herein is meant materials which can be admixed without deleteriously affecting the overall detergency performance or stability of the present compositions under reasonable use and/or storage conditions, e.g., in the home laundry.

By the term "detergency builder" herein is meant a water-soluble electrolyte material, organic or inorganic, which substantially contributes to the removal of soil, especially particulate soil such as clays, from fabric surfaces.

By the term "inversed emulsion" herein is meant an emulsion wherein the organic phase comprises the continuous medium throughout which is distributed an aqueous, disperse phase, i.e., a water-in-oil type of emulsion, rather than the more familiar oil-in-water emulsion.

By the term "an effective amount" of the present compositions is meant an amount sufficient to remove stains or soils from fabrics when applied thereto and the fabrics are concurrently or subsequently agitated in water.

By the term "comprising" herein is meant that various optional, compatible components can be used in the compositions herein, as long as the critical ingredients are present in the appropriate form and concentrations. The term "comprising" thus encompasses and includes the more restrictive terms "consisting of" and "consisting essentially of" which can be used to characterize the essential ingredients, water, electrolyte, and neat-phase, liquid crystalline surfactant, of the present compositions.

All percentages herein are by weight, unless otherwise specified.

The nonionic detersive surfactants employed herein can be described as the condensation products of a polyalkylene oxide (especially polyethylene oxide, abb. "EO") with an organic hydrophobic compound, which is usually aliphatic or alkylaromatic in nature. The alkylene oxide portion of the condensate comprises the water-soluble, or hydrophilic, portion of the surfactant molecule, while the hydrocarbyl "tail" provides the oil-soluble, or lipophilic portion.

The length of the hydrophilic or polyoxyalkylene moiety which is condensed with any particular hydrophobic compound can be readily adjusted to yield a water-soluble compound having the desired degree of balance between hydrophilic and hydrophobic elements, i.e., the hydrophilic-lipophilic balance, or HLB. Examples of suitable nonionic surfactants are:

1. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds may be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, di-isooctylphenol condensed with about 15 moles of ethylene oxide per mole of phenol. Commercially available nonionic surfactants of this type include Igepal CO-630 marketed by the GAF Corporation; and Triton X-45, X-114, X-100 and X-102, all marketed by the Rohm and Haas Company.

2. The condensation products of aliphatic alcohols with ethylene oxide. The alkyl chain or the aliphatic alcohol may either be straight or branched and generally contains from about 8 to about 22 carbon atoms. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms in length and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-6.5 marketed by the Shell Chemical Company and Kyro EOB marketed by the Procter & Gamble Company.

3. The condensation products of ethylene oxide with a hydrophobic base formed by the condensation of propylene oxide with propylene glycol. The hydrophobic portion of these compounds has a molecular weight of from about 1500 to 1800 and of course exhibits water-insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially-available Pluronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2500 to about 3000. This base is condensed with ethylene oxide to the extent that the condensation product contains from about 40 to about 80% by weight of polyoxyethylene and has a molecular weight of from about 5000 to about 11,000. Examples of this type of nonionic surfactant include certain of the commercially-available Tetronic compounds marketed by the Wyandotte Chemicals Corporation.

Preferred for use herein are nonionic surfactants of the types 1 and 2, hereinabove, i.e., polyethylene oxide-based nonionic surfactants which are condensates of ethylene oxide and a hydrocarbyl substituent. Nonionic surfactants wherein the hydrocarbyl substituent is derived from a fatty alcohol, either linear or branched-chain, are most preferred herein.

The compositions herein are especially useful for direct application to oily and mixed oily/solid soils and stains on fabric surfaces, followed by laundering in an aqueous laundering liquor. Many nonionic surfactants of the foregoing type are excellent for removing oily stains, since the surfactants, themselves, are substantially oil-like in nature. In particular, some nonionic surfactants having relatively short ($EO_1$–$EO_3$) ethoxylate chains are especially good oil removers. Unfortunately, such short-EO surfactants are not very water-soluble, and can be difficult to remove from the fabrics during the relatively short contact time of an average washing cycle.

On the other hand, some ethoxylated nonionic surfactants having long (EO above about 15 for common $C_{10-C16}$ hydrocarbyl groups) ethoxylate chains are so water-soluble that they are not optimally useful as oily stain removers.

It will be appreciated from the foregoing that the selection of optimized nonionic ethoxylated surfactants for use herein should strike a balance between oily stain removal properties and water solubility.

The balance between the water solubility and the oil solubility of the nonionic surfactants used herein can be approximately specified by the HLB of any given nonionic surfactant. Thus, the HLB provides a means for selecting optimal nonionic surfactants for use in the present compositions.

The HLB of the ethoxylated nonionic surfactants can be determined experimentally, or can be approximately calculated in the manner set forth in Becker, *Emulsions Theory and Practice,* Reinhold, 1965, pp. 233 and 248. For example, the equation $$HLB = E/5$$

wherein E is the weight percentage of oxyethylene content in the surfactant molecule, can be used to approximate the HLB of fatty alcohol ethoxylates.

Preferred for use herein by virtue of their optimal balance of oil and water solubilities are those detersive nonionic surfactants having an HLB above about 8.5, preferably in the range from about 9 to about 14, more preferably from about 10 to about 13.

Nonionic detersive surfactants which are condensates of from about 4 to about 9 EO moieties with $C_{10}$–$C_{16}$ (avg.) alcohols and having an HLB in the above-disclosed range are especially preferred.

The $EO_4$–$EO_8$ condensates of $C_{12}$–$C_{15}$ (avg.) alcohols fall within the optimal surfactant ranges and are thus most preferred for use herein.

As is well known in the art, commercially-available ethylene oxide nonionic surfactants of the type employed herein are prepared by condensing ethylene oxide monomer with a hydrocarbyl group having a reactive functionality such as a hydroxyl group, i.e., alcohols or phenols. Such commercial compositions are typically synthesized using mixtures of alcohols having an approximate chain length range. Moreover, the ethylene oxide moiety in a given surfactant will vary somewhat, and is usually expressed as a number average. It is not uncommon, therefore, to express the ethylene oxide and hydrocarbyl moieties of such surfactants as number averages or fractional number averages.

Highly preferred commercial and modified commercial nonionic detersive surfactants herein are: Neodol 45-7, which is the condensate of an average of about 7 moles of ethylene oxide with a $C_{14}$–$C_{15}$ (avg.) alcohol; Neodol 23—6.5, which is a condensate of an average of 6.5 ethylene oxide moieties with a $C_{12}$–$C_{13}$ (avg.) alcohol; and Neodol 23—3T (wherein the "T" designates "topped") which is a $C_{12}$–$C_{13}$ alcohol condensed with an overall average of 3 ethylene oxide units and having the lower ethoxylated and unreacted alcohol removed by distillation to provide a surfactant material having from about 4.7 to about 4.8 ethoxylate moieties, on the average.

The electrolytes employed herein comprise water-soluble salts which dissociate into anions and cations in water or aqueous media. Typical electrolytes are the alkali metal halides such as NaCl, NaBr, KCl, and the like, the alkali metal sulfates such as $Na_2SO_4$, $K_2SO_4$, the alkali metal carbonates, and nitrates, all well known in the art.

It is highly preferred herein, and critical to obtaining optimal detergency performance, that the electrolyte be selected from water-soluble detergency builder salts. Such electrolyte/builders are well known in the detergency arts, and extensive listings of such materials are found in the U.S. patents of F. L. Diehl, U.S. Pat. No. 3,723,322, issued Mar. 27, 1973; U.S. Pat. No. 3,597,416, issued Aug. 3, 1971; U.S. Pat. No. 3,213,030, issued Oct. 19, 1965; and U.S. Pat. No. 3,308,067, issued Mar. 7, 1967, the disclosures of which are incorporated herein by reference.

The most highly preferred electrolyte/builders herein are the water-soluble phosphates disclosed in U.S. Pat. No. 3,235,505, Tuvell, issued Feb. 15, 1966, incorporated herein by reference. Included among these builders are the alkali metal chain phosphate salts (such as, for example, the alkali metal pyrophosphates such as tetrasodium pyrophosphate, tetrapotassium pyrophosphate, etc.), the acid pyrophosphates such as disodium dihydrogen pyrophosphate, trisodium monohydrogen pyrophosphate, dipotassium dihydrogen pyrophosphate, etc., the tripolyphosphates and acid tripolyphosphates such as sodium tripolyphosphate ($Na_5P_3O_{10}$), potassium tripolyphosphate ($K_5P_3O_{10}$), tetrasodium monohydrogen tripolyphosphate ($K_4HP_3O_{10}$), tripotassium dihydrogen tripolyphosphate ($K_3H_2P_3O_{10}$), etc., the alkali metal tetrapolyphosphates such as hexasodium and hexapotassium tetrapolyphosphate, etc., the alkali metal hexametaphosphates and higher chain length chain polyphosphates such as those that are present in the sodium, potassium, and lithium phosphate "glasses" (i.e., usually prepared by melting a mixture of phosphate salts having an $M_2O/P_2O_5$ ratio between about 1.0 and 1.3 where M is an alkali metal, and "quenching" the resulting product to yield a mixture of chain polyphosphate salts of varying molecular weight), and the like (wherein the particularly preferred alkali metal salts are potassium and sodium). Of these, tetrapotassium pyrophosphate is most highly preferred.

The physical form and properties of the present compositions which result in their desirable performance benefits can perphaps best be understood by a detailed consideration of the physical chemistry involved in their preparation.

As disclosed hereinabove, the nonionic detersive surfactants employed herein are molecules having an oil-soluble "tail" and a water-soluble "head". Moreover, the surfactant molecules have many sites through which inter-molecular attractions (hydrogen bonding, Van der Waal's attractions, etc.) can occur.

The preparation of the compositions herein involves dissolving the nonionic surfactants in water. While these materials are freely soluble in water by virtue of their hydrophilic heat group, their hydrophobic (lipophilic) tail group provides a thermodynamic counter-force which tends to drive them out of aqueous solution. Water solubility is thus seen to be dependent on the ability of the water molecules to hydrate the head group and overcome the counter-force of the tail group. It will be appreciated, of course, that the lipophilic tails impart the desirable oily stain removal properties to the detersive surfactants and cannot be dispensed with.

The attraction of the polar water molecules in a pure, aqueous solution of nonionic surfactant is sufficiently strong to solubilize the surfactant molecules. However, the water molecules are more strongly attracted to charged materials such as cations or anions than to the nonionic heads of the surfactant molecules. On addition of electrolytes to the surfactant solution, the water molecules can be envisioned as dissociating themselves from the nonionic surfactant head groups and clustering around the cations and anions formed from the dissolved electrolyte. At this point, the lipophilic portion of the surfactant molecule dominates the solubility relationships and begins to drive the surfactant molecules out of the aqueous-electrolyte solution.

From the foregoing description, it will be readily understood that, if excessive amounts of electrolyte are added to the aqueous solution of nonionic surfactant, the solution will divide into separate detergent and water/electrolyte phases, which are of no utility for the present purposes and which are not encompassed by this invention.

Conversely, if only a slight amount of electrolyte is added to the aqueous surfactant solution, there is no substantial disturbance of thermodynamic equilibrium and no particular change in the solution is noted.

On the other hand, by proceeding in the manner of this invention, and by adding an appropriate and critical amount of electrolyte, concentrated aqueous solutions of nonionic surfactant can be converted to a continuous array of hydrated, neat, liquid crystals throughout the composition. Depending on the amount of surfactant (and its HLB), water and electrolyte, this liquid crystalline phase will be in the form of a gelatinous liquid, flowable gel, or even a solid at high surfactant levels. The liquid crystals in the liquid crystalline phase can be visualized as a two-dimensional network of nonionic surfactant molecules held together loosely, but stably, by intermolecular forces and water bridge-bonding. Homogeneously distributed throughout the liquid crystalline continuous phase are droplets of the aqueous electrolyte solution.

From the foregoing description, it will be appreciated that the liquid crystals of nonionic surfactant are in a highly concentrated form in the compositions herein. Moreover, the electrolyte is also in a concentrated form in the aqueous droplets which comprise the disperse phase. When applied directly to fabrics as a pre-treatment, the greasy and particulate soils are optimally confronted with a high concentration of both types of detersive ingredients and are loosened from the fabrics. Subsequent agitation in an aqueous medium removes surfactant, builder electrolyte, and soils and stains from the fabrics. Moreover, the compositions herein, though initially in gelatinous form, are easily and homogeneously dispersed throughout the aqueous liquor of the main wash.

The following describes especially preferred embodiments of the present type. Changes can be made in these embodiments without departing from the scope and spirit of this invention.

Preferred embodiments of the present invention comprise from about 45% to about 70% by weight of the surfactant in the form of hydrated, neat liquid crystals. As noted hereinabove, the surfactant is preferably a polyethylene oxide-based nonionic surfactant, most preferably polyethylene oxide-based nonionic surfactant which is a condensate of ethylene oxide and a hydrocarbyl substituent and which is further characterized by an HLB in the range from about 9 to about 14.

From the detergency standpoint, the most preferred compositions herein are those wherein the electrolyte comprises a water-soluble detergency builder salt. Stable, highly detersive compositions are those wherein the electrolyte builder salt comprises from about 3% to about 8% by weight of the total composition. Especially preferred builder salts are members selected from the group consisting of the water-soluble phosphate, polyphosphate, pyrophosphate, acid phosphate, acid pyrophosphate, acid polyphosphate and hexametaphosphate builder salts, especially those in the sodium and potassium salt form.

Especially preferred detergent compositions herein are those wherein the nonionic detersive surfactant is a condensate of an average of from about 4 to about 9 ethylene oxide moieties with a $C_{10}$–$C_{16}$ (avg.) alcohol and has an HLB in the range from about 10 to about 13. Such compositions comprising from about 45% to about 65% by weight of the nonionic detersive surfactant, and especially those which comprise from about 3% to about 8% by weight of $K_4P_2O_7$ as the builder electrolyte, are excellent and preferred detergent compositions.

Because of commercial availability, as well as excellent detergency performance and product stability, compositions having, as the surfactant, an $EO_4$–$EO_8$ condensate of ethylene oxide with a $C_{12}$–$C_{15}$ (avg.) alcohol, and $K_4P_2O_7$ as the electrolyte builder salt, within the preferred ranges disclosed hereinabove, are especially useful and economical pre-treatment/detergent compositions.

Particular preferred embodiments of the foregoing type are detergent compositions which consist essentially of: from about 60% to about 65% by weight of a nonionic detersive surfactant which is a member selected from the group consisting of the $EO_7$ (avg.) condensates of $C_{14}$–$C_{15}$ (avg.) alcohols, the $EO_{6.5}$ (avg.) condensates of $C_{12}$–$C_{13}$ (avg.) alcohols, and the $EO_{4.7}$–$EO_{4.8}$ (avg.) condensates of $C_{12}$–$C_{13}$ (avg.) alcohols; from about 3% to about 6% by weight of $K_4P_2O_7$; the balance, water; said compositions having a viscosity in the range of about 25,000–35,000 cps.

Thinner, homogeneous compositions of the foregoing type consist essentially of: from about 45% to about 55% by weight of the detersive surfactant; from about 2% to about 5% by weight of the $K_4P_2O_7$; the balance comprising water; said compositions being characterized by a viscosity in the range of about 800–1200 cps.

The compositions herein are useful pre-treatments for stained and soiled fabrics. Pre-treatment use comprises applying an effective amount of the present compositions directly to the stain and briefly rubbing the composition into the stained fabric prior to subsequent laundering in an aqueous laundering medium. The amount of composition used will, of course, depend on the extent of the stain. In many instances, and especially when stains are treated on several fabrics to be laundered in the same laundering bath, a sufficient quantity of the present compositions will be carried into the laundering liquor to wash all the fabrics therein without the need for adding additional detergent material.

For use in the main wash, the compositions herein are simply added to an aqueous laundering bath. Under normal-to-heavy soil loads, the compositions herein optimally comprise from about 0.05% to about 0.1% by weight of the water used in the bath.

The compositions herein are effective main wash detergents at the cool, warm and hot water temperatures normally employed in automatic washing machines.

It will be appreciated that the present compositions can comprise additional, compatible ingredients which are added thereto for various aesthetic and performance benefits. Such materials include, for example, various perfumes, bleaches, optical bleaches, soil anti-redeposition agents, auxiliary detersive surfactants, and the like, well known in the detergency arts. Such additional materials normally will comprise no more than about 1% or 2% by weight of the total compositions.

The following examples illustrate the compositions and methods of this invention, but are not intended to be limiting thereof.

EXAMPLE I

A detergent composition of the type encompassed by this invention in the form of a flowable gel is as follows.

| Ingredient | % (wt.) |
|---|---|
| Neodol 45-7 | 63 |
| $K_4P_2O_7$ | 5 |
| Water | 32 |

The composition of Example I is prepared by admixing the ingredients in the manner disclosed hereinabove. The composition has a viscosity in the range of 30,000 cps (Brookfield; Spindle #6; 72° F) and is in the form of a stable, homogeneous, flowable gel comprising an inversed emulsion.

The composition of Example I is applied to stains comprising lipstick, clay, dirty motor oil, and vegetable oil, on cotton, polyester, polyester/cotton blend and nylon fabrics. The amount applied varies with the extent of the stain. The composition is thoroughly rubbed or brushed into the stain and the fabric is thereafter laundered in an aqueous laundering solution comprising from about 0.05% to about 0.1% by weight of the composition of Example I. Laundering is done in a standard automatic home washing machine.

Overall performance of the composition of Example I in usage situations of the foregoing type is judged to be superior to treatments with commercial spot remover/-pre-treatment laundering compositions followed by laundering in standard, phosphate-built anionic detergent compositions, across the spectrum of soil and fabric types noted.

The fabric cleaning performance of the composition of Example I is especially noteworthy, inasmuch as the pre-treatment time is on the order of 30–60 seconds. Many commercial laundry pre-treatments require a substantially longer contact time on the stain to be effective.

The composition of Example I is modified by replacing the Neodol 45–7 with an equivalent amount of Neodol 23–6.5 and Neodol 23–3T, respectively, and substantially equivalent results are secured.

The composition of Example I is modified by replacing the $K_4P_2O_7$ with an equivalent amount of sodium tripolyphosphate and an excellent detergent and laundry pre-treatment composition is secured.

EXAMPLE II

A detergent composition of the type encompassed by this invention in the form of a gelatinous liquid is as follows.

| Ingredient | % (wt.) |
|---|---|
| Neodol 45-7 | 50 |
| $K_4P_2O_7$ | 4 |
| Water | 46 |

The composition of Example II is prepared by admixing the ingredients in the manner disclosed hereinabove. The composition has a viscosity in the range of 1,000 cps (Brookfield; Spindle #3; 72° F) and is in the form of a stable, homogeneous, gelatinous liquid comprising an inversed emulsion.

The composition of Example II is applied to stains comprising lipstick, clay, dirty motor oil, and vegetable oil, on cotton, polyester, polyester/cotton blend and nylon fabrics. The amount applied varies with the extent of the stain. The composition is thoroughly rubbed or brushed into the stain and the fabric is thereafter laundered in an aqueous laundering solution comprising from about 0.05% to about 0.1% by weight of the composition of Example II. Laundering is done in a standard automatic home washing machine.

Overall performance of the composition of Example II in usage situations of the foregoing type is judged to be superior to treatments with commercial spot remover/pre-treatment laundering compositions followed by laundering in standard, phosphate-built anionic detergent compositions, across the spectrum of soil and fabric types noted.

EXAMPLE III

The composition of Example I herein is packaged in a pliable, polyethylene bottle. The bottle is fitted with a brush applicator cap. The applicator cap is provided with a hole through its central portion, said hole having a diameter of ca. 1/16 inch. The bottle is inverted on a flanged base which seals the container and provides a convenient support for the inverted bottle containing the flowable gel detergent composition.

The desirable thickness of the composition prevents gravity flow through the hole in the applicator cap when the bottle is stored in the inverted position. In use, the flowable properties of the composition allow it to be dispensed directly onto stains by gently squeezing the sides of the bottle. Gentle scrubbing with the brush applicator cap facilitates stain removal.

EXAMPLE IV

A detergent composition of the type encompassed by this invention in the form of a thick, yet flowable gel is as follows.

| Ingredient | % (wt.) |
|---|---|
| $TAE_9$* | 70 |
| $K_4P_2O_7$ | 10 |
| Water | 20 |

*Ethoxylated (avg. EO = 9) mixed tallow fatty alcohols.

The composition of Example IV is prepared by admixing the ingredients in the manner disclosed hereinabove. The composition has a viscosity in the range of 50,000 cps and is in the form of a stable, homogeneous, flowable gel comprising an inversed emulsion.

The composition of Example IV is applied directly to fabrics stained with lipstick, clay, dirty motor oil, and vegetable oil. The amount applied varies with the extent of the stain. The composition is thoroughly rubbed or brushed into the stain and the fabric is thereafter laundered in a aqueous laundering solution comprising from about 0.05% to about 0.1% by weight of the composition of Example IV. Laundering is done in a standard automatic home washing machine. Stains and soils are effectively removed.

In the composition of Example IV, the $TAE_9$ is replaced by an equivalent amount of the heptaethoxylate of mixed secondary alcohols (comprising average $C_{11}$–$C_{15}$ chain lengths) available as Tergitol 15-S-7, n-$C_{16}EO_9$, and n-$C_{10}EO_4$, respectively, and excellent cleaning performance is secured.

In the composition of Example IV, the $K_4P_2O_7$ (which is highly soluble and preferred herein) is replaced by an equivalent amount of potassium tripolyphosphate to provide an excellent detergent.

What is claimed is:

1. A gelatinous liquid or flowable gel detergent composition which comprises greater than about 40% by weight of a nonionic alkylene oxide detersive surfactant, from about 2% to about 10% by weight of a detergency builder salt, the balance comprising water, said detergent composition being in the form of an inversed emulsion, said inversed emulsion consisting of:

(a) a first, continuous phase comprising hydrated, nonionic alkylene oxide detersive surfactant in the form of neat liquid crystals; and (b) a second, disperse phase comprising an aqueous solution of detergency builder salt, said disperse phase being substantially homogeneously distributed throughout said continuous phase.

2. A composition according to claim 1 comprising from about 45% to about 70% by weight of surfactant in the form of hydrated neat liquid crystals.

3. A composition according to claim 2 wherein the nonionic surfactant is a polyethylene oxide-based nonionic surfactant.

4. A composition according to claim 3 wherein the polyethylene oxide-based nonionic surfactant is a condensate of ethylene oxide and a hydrocarbyl substituent and is characterized by an HLB in the range from about 9 to about 14.

5. A composition according to claim 1 wherein the detergency builder salt comprises from about 3% to about 8% by weight of the composition.

6. A composition according to claim 5 wherein the detergency builder salt is a member selected from the group consisting of the water-soluble phosphate, pholyphosphate, pyrophosphate, acid phosphate, acid pyrophosphate, acid polyphosphate and hexametaphosphate builder salts.

7. A composition according to claim 1 wherein the nonionic detersive surfactant is a condensate of an average of from about 4 to about 9 ethylene oxide moieties with a $C_{10}$–$C_{16}$ (avg.) alcohol and has an HLB in the range from about 10 to about 13.

8. A composition according to claim 6 which comprises from about 45% to about 65% of the nonionic detersive surfactant.

9. A composition according to claim 8 which comprises from about 3% to about 8% of $K_4P_2O_7$ as the builder.

10. A composition according to claim 10 which comprises, as the surfactant, an $EO_4$-$EO_8$ condensate of ethylene oxide with a $C_{12}$–$C_{15}$ (avg.) alcohol, and $K_4P_2O_7$ as the detergency builder salt.

11. A composition according to claim 10 which consists essentially of about 60% -65% by weight of a nonionic detersive surfactant which is a member selected from the group consisting of the $EO_7$ (avg.) condensate of $C_{14}$–$C_{15}$ (avg.) alcohols, the $EO_{6.5}$ (avg.) condensate of $C_{12}$–$C_{13}$ (avg.) alcohols, and the $EO_{4.7}$–$EO_{4.8}$ (avg.) condensate of $C_{12}$–$C_{13}$ (avg.) alcohols; from about 3% to about 6% by weight of $K_4P_2O_7$; the balance, water; said composition having a viscosity in the range of about 25,000–35,000 cps.

12. A composition according to claim 10 which consists essentially of about 45% to about 55% by weight of a nonionic detersive surfactant which is a member selected from the group consisting of the $EO_7$ (avg.) condensate of $C_{14}$–$C_{15}$ (avg.) alcohols, the $EO_{6.5}$ (avg.) condensate of $C_{12}$–$C_{13}$ (avg.) alcohols, and the $EO_{4.7}$–$EO_{4.8}$ (avg.) condensate of $C_{12}$–$C_{13}$ (avg.) alcohols; from about 2% to about 5% by weight of $K_4P_2O_7$; the balance, water; said composition having a viscosity in the range of about 800–1200 cps.

* * * * *